United States Patent [19]

Autry et al.

[11] Patent Number: 4,815,653

[45] Date of Patent: Mar. 28, 1989

[54] AUTOMATIC REMOVAL OF STORAGE BIN BUILD-UP

[75] Inventors: Farrell Autry, Sewickley; William Vicini, Midland; Roland Harr, Coraopolis, all of Pa.

[73] Assignee: Serve-All, Inc., Glenwillard, Pa.

[21] Appl. No.: 16,413

[22] Filed: Feb. 19, 1987

[51] Int. Cl.[4] ..... E21C 37/00

[52] U.S. Cl. ..... 299/18; 222/196

[58] Field of Search ..... 414/297, 311, 314; 15/304; 222/195, 196, 228, 226; 299/88, 16; 366/126, 124, 101

[56] References Cited

U.S. PATENT DOCUMENTS

| | | | |
|---|---|---|---|
| 2,075,093 | 3/1937 | Cannon | 366/124 X |
| 2,174,348 | 9/1939 | Damond | 222/196 |
| 2,733,840 | 2/1956 | Kolks | 222/195 |
| 2,803,445 | 8/1957 | Borrowdale | 299/77 X |
| 3,020,720 | 2/1962 | Spalding | 366/124 X |
| 3,070,361 | 12/1962 | Pew, II | 299/17 |
| 3,166,222 | 1/1965 | Schrader | 222/195 |
| 3,337,094 | 8/1967 | Houston | 222/196 |
| 3,525,445 | 8/1970 | Barger | 222/196 |
| 3,722,836 | 3/1973 | Savage et al. | 366/101 X |
| 3,897,605 | 8/1975 | Dickinson | 15/382 |
| 4,360,276 | 11/1982 | Jack | 366/101 |
| 4,383,715 | 5/1983 | Scott et al. | 299/88 |
| 4,509,701 | 4/1985 | Jack et al. | 222/228 X |

*Primary Examiner*—Stephen J. Novosad
*Assistant Examiner*—Matthew Smith
*Attorney, Agent, or Firm*—Banner, Birch, McKie & Beckett

[57] ABSTRACT

The present invention is directed to a cutting tip device, and method of using the device, for removing the build-up of particulate from an internal surface of a storage bin, such as a coal bunker or a grain silo. The cutting tip is attached to a source of compressed gas by a hose, and includes at least one internal gas passageway through which the compressed gas is forced. The compressed gas is at a predetermined minimum pressure and flow rate sufficient to cause the cutting tip to gyrate in an erratic fashion about the hose, and to strike the build-up with sufficient force to remove the particulate from the interior of the storage bin. By lowering a hose having the cutting tip attached to it into a storage bin and forcing compressed gas through the hose and cutting tip, the interior of the storage bin is cleared of its build-up.

43 Claims, 3 Drawing Sheets

AUTOMATIC REMOVAL OF STORAGE BIN BUILD-UP

BACKGROUND OF THE INVENTION

1. Technical Field

The present invention is directed to a method and apparatus for automatically removing the build-up of particulate in a storage bin, such as a coal bunker, grain silo, and the like.

More particularly, the present invention is directed to a cutting tip device, and method of use, attached to a source of compressed gas via a hose, wherein the compressed gas is forced through the cutting tip device causing the device to gyrate in an erratic fashion about the hose and to strike the build-up, the force created thereby removing the build-up from the storage bin.

2. Background Information

Storage bins, such as coal bunkers and grain silos, are typically either cylindrical or rectangular, although other shapes are well known to those skilled in the art. Typically, storage bins include an inlet at or near the top of the bin for feeding the stored material into the bin. The stored material is removed typically through conical-shaped hoppers located at the bottom of the storage bin. As is known in the art, storage bins which house coal are typically referred to as coal bunkers; those that house grain are typically referred to as silos.

Typically, coal bunkers house several thousand tons of coal. The dimensions of a typical cylindrical coal bunker are about 70 feet in diameter and over 110 feet high; a typical rectangular coal bunker is 25 by 80 feet by over 50 feet deep. Turning now to FIG. 1, a typical prior art coal bunker is shown. The coal is fed into the bunker by means of a conveyor belt (not shown) positioned near top 21 of the coal bunker. The coal is removed from the bunker through conical-shaped hoppers, such as hopper 22, located at the bottom of the bunker. Through use, coal tends to build up along side walls 23 of the bunker, thereby reducing the effective capacity of the bunker.

Turning now to FIG. 2, a typical pattern of coal build-up along the interior walls of the coal bunker is shown. Build-up 24 reduces the effective capacity of the bunker. Additionally, the build-up near opening 25 can cause coal flow out of the bunker to stop due to the restriction caused by the build-up. This condition, typically referred to as a "rat hole", not only halts the flow of coal from the coal bunker, but also halts the production of steel should the bunker be on-line in a steel plant.

Should the coal bunker develop the rat hole, the maintenance and/or production supervisor in the coal plant will attempt to clear it so that production can continue. Although it is possible in some applications to use the contents of a different coal bunker, other applications require the coal stored in the specific coal bunker to be used due to the specific composition and/or mixture of the coal, or the like.

Generally, the rat hole is attempted to be cleared manually by jack hammers, pick axes, shovels, and the like. It has also been known, albeit infrequently, to employ a stream of water in an effort to clear the rat hole. However, any coal cleared by this method must be scrapped. Water contaminates the coal and renders it unseless; wet coal cannot be used even if placed into a pre-burner.

Thus, coal bunkers are cleaned on a periodic basis as a means of preventive maintenance. As is known in the art, prior art methods of cleaning the build-up are directed to sending a crew of workmen into the bunker to manually remove the build-up, usually by jack hammer, pick axe, and the like. The crew of workmen are typically lowered into the bunker from the top and safety lines are attached to the workmen to help prevent accidents. However, despite the safety lines attached to the workmen, this method is quite dangerous. Should a large portion of build-up break from the wall, and should a workman get caught in the falling debris, the weight of it can drag the workman down, despite the safety lines. It is well known and documented that many lives have been lost throughout the years due to this cleaning process, in spite of safety lines.

The problems associated with coal bunkers are also inherent with grain silos. Prior art devices are known in the art for helping induce the flow of material through grain silos when build-ups or bridges occur. (A bridge is formed when the material emptied from the bottom of a storage bin forms a void at its angle of repose, the gravitational weight of the material above the bridge being insufficient to overcome the friction along the surface area of the void when the material is at or near its angle of repose.) For example, as shown in U.S. Pat. No. 3,525,445 issued to Barger, herein incorporated by reference, a grain silo is shown for housing soybean meal. One of the problems with soybean meal is that it sticks to the interior walls of the storage bin, thereby preventing the flow of the mal therethough. Barger includes a series of inflatable hoses along the side walls of the storage bin which are inflatable to help the particles of soybean meal stuck to the side of the wall to dislodge, eventually exiting the hopper at its bottom. The inflatable hoses are rigidly attached near the top and bottom opening of the silo, and attached near the side walls of the conical-shaped hopper with a spring device which allows the hose, when inflated, to move away from the silo wall, creating an incline for the meal to slide down and breaking it up from the sides of the silo. The spring device causes the hose to return to the side wall one it is deflated. In U.S. Pat. No. 3,337,094 issued to Houston, herein incorporated by reference, a plurality of air-tight tubes run throughout the interior of a grain silo and are attached at the exterior of the silo to an air pump. When a bridge forms in the grain silo, the air pump is activated causing the air tubes to inflate. Due to the plurality of tubes located within the grain silo, at least one of the tubes should intersect the bridge formed in the silo. When that tube is inflated, the angle of repose is broken, and the gravitational weight of the material above the bridge further breaks down the bridge, restoring the flow of the grain through the silo. Although both Barger and Houston work well in grain environments, such devices would not be adequate in environments where the particulate of the build-up is more compact and heavy, such as in a coal bunker.

SUMMARY OF THE INVENTION

Accordingly, it an object of the present invention to provide a method and apparatus for removing the build-up of compact and dense particulate from the interior walls of a storage bin.

Additionally, it is another object of the present invention to automatically and safely remove build-up in a storage bin without the inherent drawbacks of the prior art, that is, risk to human life.

Furthermore, it is an object of the present invention to provide a method and apparatus for automatically removing the build-up of particulate in a coal bunker in a way which is safe, reliable and time-efficient, and to do so with a minimum of supervision and manual labor.

In accordance with these and other objects, the present invention is directed to a cutting tip device, and method of use, for removing the build-up of particulate from an interior surface of a storage bin, such as coal build-up in a coal bunker. The present invention removes the build-up by striking against the particulate with sufficient force to knock it from the interior surface of the storage bin. The cutting tip device is supplied with compressed gas via a hose, and comprises an impacting head having an exterior surface and an attachment surface, the impacting head being connectable to the hose via an attachment means which connects to the impacting head at its attachment surface. The impacting head includes at least a first internal gas passageway in fluid communication with the hose for directing the gas from the hose, through the interior of the head, to the exterior of the head. The compressed gas, supplied by a source at a minimum predetermined pressure and flow rate, travels through the impacting head's internal gas passageway. The compressed gas is at a pressure and flow rate sufficient to cause the impacting head to gyrate in an erratic fashion about the hose when the gas flows therethrough. The movement of the head in this fashion causes it to strike the build-up with sufficient force to remove the particulate from the interior surface of the storage bin.

The impacting head can have any shape, such as spherical, cubic, cylindrical, or any n-polygonal shape, as well as any irregular shape. Additionally, the impacting head can have either a single or a plurality of internal gas passageways connected between the hose and any portion along the exterior surface of the impacting head.

The present invention may be constructed out of any material suitable for the required application. For example, brass may be used in environments where it is inherently dangerous for sparks to be created when the head impacts the particulate, such as in a coal bunker. Alternatively, steel, such as carbon or stainless, may also be used, as well as a plastic composition, wood or the like.

The compressed gas should be at a minimum predetermined pressure in order for the present invention to operate properly, that is, create sufficient impact force against the build-up. The minimum predetermined pressure is dependent upon the specific application. Furthermore, it has been found that the present invention requires that the compressed gas have a minimum predetermined flow rate, also dependent upon the specific application.

In some applications, it has been found to be advantageous to employ a plurality of cutting tips, most preferably attaching several to a common source of compressed gas via a manifold, the manifold being fed by a single supply line by the source of compressed gas, and a plurality of hoses stemming from the manifold to the plurality of cutting tips. The minimum predetermine flow rate of the compressed gas, therefore, is also dependent upon the number of cutting tips connected to the common source of compressed gas.

DESCRIPTION OF THE PREFERRED EMBODIMENTS

Figure 3:
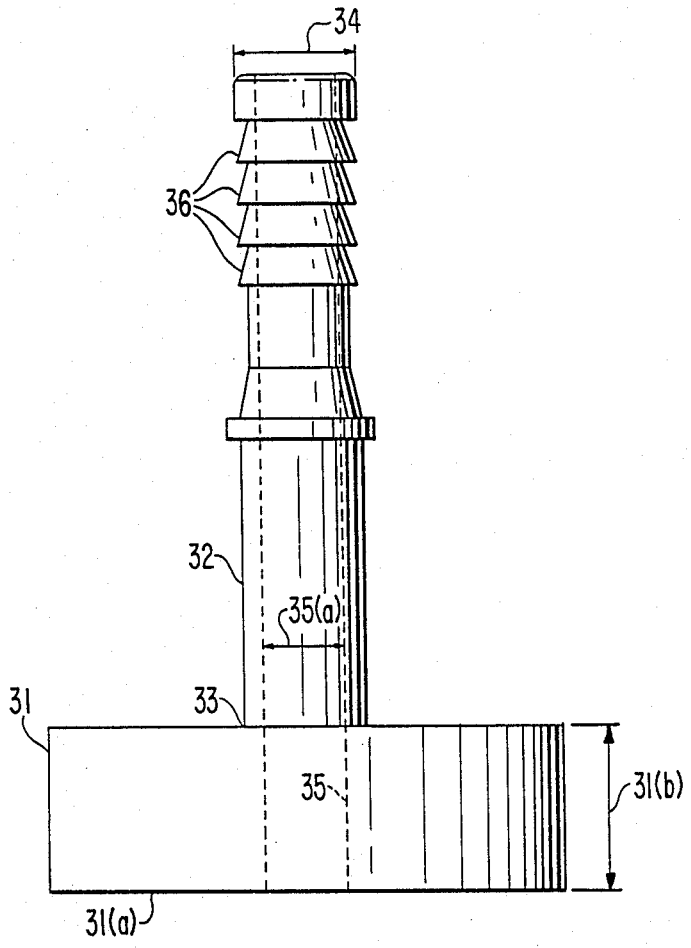
FIG. 3 illustrates the preferred embodiment of the cutting tip of the present invention having a single internal gas passageway.
Figure 4A:
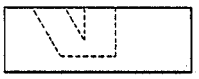
FIGS. 4(*a*)–(*i*) illustrate other embodiments for the internal gas passageway of the cutting tip shown in FIG. 3.
Figure 4B:
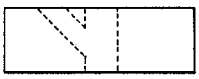
Figure 4C:
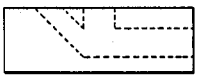
Figure 4D:
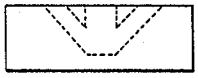
Figure 4E:
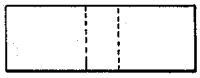
Figure 4F:
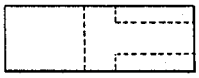
Figure 4G:
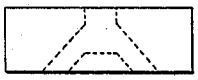
Figure 4H:
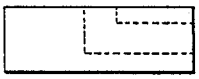
Figure 4I:
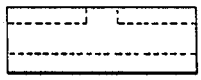

Turning now to FIG. 3, the preferred embodiment of the cutting tip of the present invention is shown, and includes impacting head 31 and elongated arm 32 attached to the impacting head at attachment surface 33. Although the elongated arm may be attached to the impacting head by any means, such as weld, glue, threads or the like, the elongated arm is welded to the impacting head in the preferred embodiment.

Elongated arm 32 comprises a plurality of ribs 36 for securing the compressed gas hose thereto, preferably with removable screw-type clamps, a device well known to those skilled in the art. In the preferred embodiment, the hose has an inside diameter of 0.75 inches. Thus, in the preferred embodiment, dimension 34 is also 0.75 inches.

As shown is FIG. 3, the preferred embodiment of the cutting tip includes internal gas passageway 35 running throughout the interior of both the elongated arm and the impacting head. However, it will be appreciated by those skilled in the art that any number of such internal gas passageways connected between the end of the elongated arm and any portion of the exterior of the impacting head is available. Some possible permutations for two internal gas passageways for the cutting tip of FIG. 3 are shown with reference to FIG. 4.

Returning now to FIG. 3, in the preferred embodiment, the elongated arm and impacting head of the cutting tip are cylindrical in shape. However, other shapes are also available for both the elongated arm and the impacting head. For example, the elongated arm can be any shape or length so long as the impacting head is able to be attached to the hose. Additionally, the impacting head can be of any size or shape, such as spherical, cubic, rectangular, cylindrical, n-polygonal shape such as a pentagon, hexagon, star-configuration, and the like, as well as any irregular shape.

The device can be constructed out of any number of materials, dependent on the specific application. For example, in applications where it is inherently unsafe for sparks to be created when the head impacts the particulate built up along the walls of the storage bin, the device is preferably constructed of brass. Alternatively, the impacting head could be constructed of another material with a layer of brass thereover, thereby increasing the strength of the cutting tip impacting head while providing a spark-free outer material. Alternatively, the impacting head could be constructed of a material comprising steel, such as stainless or carbon, plastic, glass, wood, and the like, dependent upon the composition of the particulate built-up along the interior walls of the storage bins.

Figure 1:
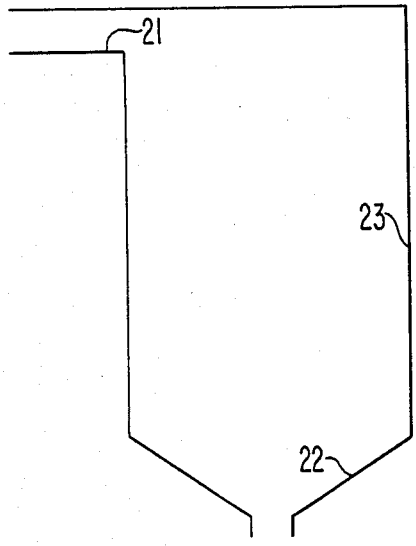
FIG. 1 (PRIOR ART)
FIG. 1 illustrates a typical prior art coal bunker.
Figure 2:
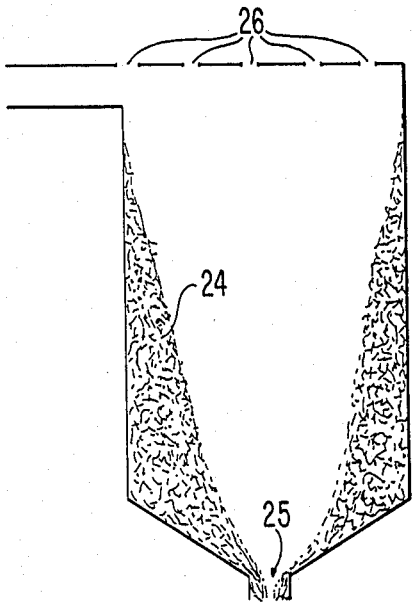
FIG. 2 (PRIOR ART)
FIG. 2 illustrates a typical pattern of coal build-up along the interior walls of the coal bunker shown in FIG. 1.
Figure 5:
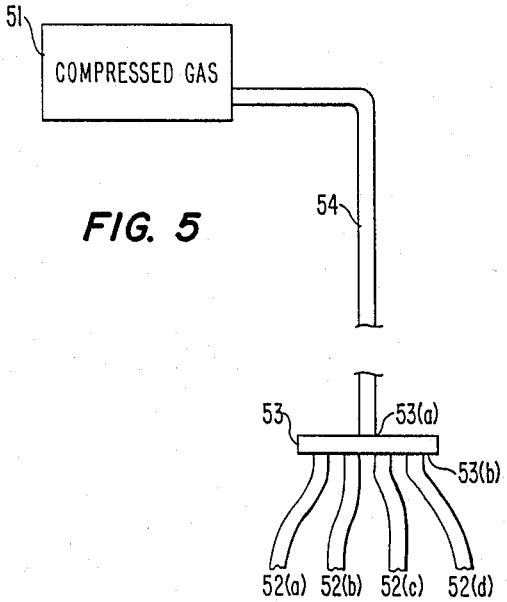
FIG. 5 illustrates the major components necessary for using a plurality of cutting tips with a common source of compressed gas.

Turning now to FIG. 2, when the present invention is used to clean the coal built-up along the walls of a coal bunker, access to the coal build-up is achieved, in the preferred embodiment, by cutting a plurality of holes 26 in the top of the coal bunker and lowering the cutting tip down to the coal build-up. In the coal bunker environment, it is preferable to employ a plurality of cutting tips attached to a common source of compressed air. Turning now to FIG. 5, the apparatus for achieving this is shown, and includes source of compressed gas 51 connected to a plurality of cutting tips (not shown) via hoses 52(*a*)–(*d*). The plurality of hoses are attached to the common source of compressed gas by manifold 53 and hose 54. In the preferred embodiment, manifold 53 has inlet port 53*a* being at least 2 inches in diameter, and at least 4 output ports 53*b* preferably of 0.75 inches in diameter, although other dimensions will be readily apparent to those skilled in the art. In this way, hose 54 comprises a 2 inch internal diameter, and hoses 52(*a*)–(*d*) comprise inside diameters of 0.75 inches.

In the preferred embodiment, the source of compressed air has a predetermined minimum gauge pressure and flow rate. It has been found that these parameters relate to the rate at which the impacting head gyrates in an erractic fashion about the hose when the compressed gas travels through the impacting head's internal gas passageway(s). Generally, coal plants having internal air lines of compressed air at about 90 psi. Although pressure as low as 50 psi is adequate for cleaning the build-up of coal in a coal bunker, it is more preferably that the minimum predetermined pressure be 120 psi, and more preferably 150 psi for the configuration shown in FIG. 5. Furthermore, it is been found that the compressed gas should have a flow rate of at least 500 cubic feet per minute (cfm), and more preferably a flow rate of at least 750 cfm when used in the configuration shown in FIG. 5. However, it will be readily apparent to those skilled in the art that other parameters and configurations are available, depending upon the application, i.e., density, and structural composition of the particulate built up, the rate at which cleaning is to be conducted, the internal diameters of hoese 54 and 52, as well as the diameter of internal passageway(s) 35 of the cutting tip shown in FIG. 3.

Returning now to FIG. 3, the dimensions of the preferred embodiment of the cutting tip are now given. In the preferred embodiment, impacting head 31 comprises substantially circular surface 31(*a*) of 3.5 inches in diameter, height 31*b* being 1 inch. Outside diameter 34 of elongated arm 32, as described above, is 0.75 inches, while the overall height of the present invention is 5 inches. The dimension of internal gas passageway 35*a* is preferably 0.5 inches, and more preferably 9/16 inches. Different diamensions will be readily apparent to those skilled in the art, as well as other configurations for the elongated arm, impacting head and internal passageway. For example, the internal passageway(s) may not be uniformed throughout, tapering in order to effect both the air flow through the device and the required minimum pressure and air flow rates.

Accordingly, although illustrated embodiments of the present invention have been described in detail with reference to the accompanying drawings, it is to be understood that the invention is not limited to those precise embodiments. Various changes or modifications may be effected therein by one skilled in the art without departing from the scope or spirit of the present invention.

What we claim as our invention is:

1. A device for automatically removing the build-up of particulate adhering to an interior surface of a storage bin that is substantially empty of freely flowing discrete particles of stored material , said device being connectable to a source of compressed gas by a flexible hose so that said entire device is gyratable, said device comprising:

an impacting head having an exterior surface for forcibly striking the build-up on the interior surface and a first internal gas passageway having at least one opening, said first internal gas passageway being in fluid communication with the flexible hose for directing the gas from the flexible hose, through the interior of said impacting head, to the exterior and out of said impacting head through said first internal gas passageway; and attachment means for connecting said impacting head to the flexible hose, said attachment means being connectable at a first end to said impacting head and connectable at a second end to the flexible hose;

wherein said passageway is dimensioned such that the compressed gas flows through said impacting head at a pressure sufficient to cause said impacting head to gyrate erratically and to strike forcibly and remove the build-up from the interior surface of the storage bin.

2. The device of claim 1, said attachment means comprising an elongated arm having a first end securedly attached to said impacting head and a second end for attachably connecting to the hose

3. The device of claim 1, wherein the exterior surface of said impacting head is substantially cylindrical, said exterior surface comprising:

first and second substantially circular surfaces, said first end of said attachment means being connectable to said first surface ; and a surface therebetween to connect said first and second surfaces together.

4. The device of claim 3, said first substantially circular surface further including a first portion of said exterior surface to which said first internal gas passageway is connected.

5. The device of claim 4, said surface therebetween including a second portion of said exterior surface to which a second internal gas passageway is connected, wherein the gas also exits said impacting head through an opening in said second internal gas passageway.

6. The device of claim 4, said first substantially circular surface further including a second portion of said exterior surface to which a second internal gas passageway is connected, wherein the gas also exits said impacting head through an opening in said second internal gas passageway.

7. The device of claim 3, said second substantially circular surface including a first portion of said exterior surface to which said first internal gas passageway is connected.

8. The device of claim 7, said second substantially circular surface further including a second portion of said exterior surface to which a second internal gas passageway is connected, wherein the gas also exits said impacting head through an opening in said second internal gas passageway.

9. The device of claim 7, said surface therebetween including a second portion of said exterior surface to which a second internal gas passageway is connected, wherein the gas also exits said impacting head through an opening in said second internal gas passageway.

10. The device of claim 3, said surface therebetween including a first portion of said exterior surface to which said first internal gas passageway is connected.

11. The device of claim 10, said surface therebetween further including a second portion of said exterior surface to which a second internal gas passageway is connected, wherein the gas also exits said impacting head through an opening in said second internal gas passageway.

12. The device of claim 1, the exterior surface of said impacting head comprising:

first and second n-polygonal surfaces, said first n-polygonal surface including said attachment surface; and n surfaces therebetween to connect the n sides of said first and second n-polygonal surfaces together.

13. The device of claim 1, the exterior surface of said impacting head comprising:

first and second n-polygonal surfaces, said first n-polygonal surface including said attachment surface; and n generally rectangular surfaces therebetween to connect the n sides of said first and second n-polygonal surfaces together.

14. The device of claim 1, said impacting head comprising brass.

15. The device of claim 1, said impacting head comprising steel.

16. The device of claim 15, said steel being stainless steel.

17. The device of claim 1, said minimum predetermined pressure being 50 psi.

18. The device of claim 1, said minimum predetermined pressure being 120 psi.

19. The device of claim 1, said minimum predetermined pressure being 150 psi.

20. The device of claim 19, said compressed gas having a flow rate of at least 500 cfm.

21. The device of claim 19, said compressed gas having a flow rate of at least 750 cfm.

22. A method of removing build-up of particulate adhering to an interior surface of a storage bin that is substantially empty of freely flowing discrete particles of stored material, the steps of the method comprising:

suspending an elongated flexible hose into the interior of the storage bin;

attaching an impacting head having an exterior surface for forcibly striking the build-up on the interior surface of the bin adjacent the end of the hose and a dimensioned gas passageway; and flowing compressed gas through the hose and the impacting head at a pressure sufficient to cause the impacting head to gyrate erratically and to strike forcibly the build-up, thereby removing the build-up from the interior surface of the storage bin.

23. The method of claim 22, wherein the compressed gas is passed through the impacting head at a pressure of at least 50 psi.

24. The method of claim 22, wherein the compressed gas is passed through the impacting head at a pressure of at least 100 psi.

25. The method of claim 22, wherein the compressed gas is passed through the impacting head at a pressure of at least 150 psi.

26. The method of claim 22, wherein the compressed gas is passed through the impacting head at a flow rate of at least 500 cfm.

27. The method of claim 22, wherein the compressed gas is passed through the impacting head at a flow rate of at least 750 cfm.

28. The method of claim 25, wherein the compressed gas is passed through the impacting head at a flow rate of at least 500 cfm.

29. The method of claim 25, wherein the compressed gas is passed through the impacting head at a flow rate of at least 750 cfm.

30. The method of claim 22, wherein the gas passes co-axially through the impacting head and the hose.

31. The method of claim 22, wherein the gas passes through the impacting head at an angle relative to the axis of the hose at the point of connection to the impacting head.

32. The method of claim 22, wherein said gas passes through the impacting head through a plurality of internal gas passageways.

33. The device of claim 1 wherein the compressed gas is compressed air.

34. The device of claim 17 wherein the compressed gas is compressed air.

35. The device of claim 20 wherein the compressed gas is compressed air.

36. The method of claim 22 wherein the compressed gas is compressed air.

37. The method of claim 23 wherein the compressed gas is compressed air.

38. The method of claim 28 wherein the compressed gas is compressed air.

39. The method of claim 26 wherein the compressed gas is compressed air.

40. The device of claim 4, said second substantially circular surface including a second portion of said exterior surface to which a second internal gas passageway is connected, wherein the gas also exits said impacting head through an opening in said second internal gas passageway.

41. The device of claim 1, wherein said impacting head comprises a polyhedron.

42. The method of claim 22 further comprising the steps of lowering the impacting head further into the storage bin a distance of 6"–12";

repeating the flowing step; and repeating the lowering and repeating steps until the build-up of particulate is removed.

43. An apparatus for automatically removing the build-up of particulate adhering to an interior surface of a storage bin that is substantially empty of freely flowing discrete particles of stored material, said apparatus comprising:

at least one flexible hose;

an impacting head connected to each said flexible hose, each impacting head having an exterior surface for forcibly striking the build-up on the interior surface and a first internal gas passageway having at least one opening, said first internal gas passageway being in fluid communication with said flexible hose for directing gas from said flexible hose, through the interior of said impacting head, to the exterior and out of said impacting head through said first internal gas passageway;

attachment means for connecting said impacting head to said flexible hose, said attachment means being connected at a first end to said impacting head and connected at a second end to said flexible hose;

a source of compressed gas for supplying compressed gas to said flexible hose, said source of compressed gas being connected to said flexible hose; and support means for supporting said flexible hose within the storage bin;

wherein said passageway is dimensioned such that the compressed gas flows through said impacting head at a pressure sufficient to cause said impacting head to gyrate erratically and to strike forcibly and remove the build-up from the interior surface of the storage bin.

* * * * *